United States Patent [19]

Newman

[11] Patent Number: 4,472,848

[45] Date of Patent: Sep. 25, 1984

[54] APPARATUS AND METHOD FOR POSITIONING A BEDRIDDEN PATIENT ON A BEDPAN

[76] Inventor: Clarence R. Newman, 815 Bayou River, Houston, Tex. 77079

[21] Appl. No.: 380,299

[22] Filed: May 20, 1982

[51] Int. Cl.[3] ..... A47G 7/02

[52] U.S. Cl. ..... 5/463; 5/81 R

[58] Field of Search ..... 5/463, 431, 81 R, 90, 5/82 R; 4/456; D6/201-204

[56] References Cited

U.S. PATENT DOCUMENTS

| | | | |
|---|---|---|---|
| 1,227,022 | 5/1917 | Thompson . | |
| 2,224,353 | 12/1940 | Laufenburg | 4/456 |
| 2,955,294 | 10/1960 | Silverstein | 4/456 |
| 3,403,411 | 10/1968 | Steinemann et al. | 5/81 R |
| 3,729,749 | 5/1973 | Rosecrans | 4/452 |
| 4,122,565 | 11/1977 | Hoben | 5/90 |
| 4,207,633 | 6/1980 | Smith et al. | 5/463 |

FOREIGN PATENT DOCUMENTS

| | | | |
|---|---|---|---|
| 2477011 | 9/1981 | France | 5/82 R |
| 928406 | 6/1963 | United Kingdom | 5/463 |

*Primary Examiner*—Alexander Grosz

*Attorney, Agent, or Firm*—Jack W. Hayden

[57] ABSTRACT

A urethane foam generally rectangular pad comprises an upper patient support surface and a parallel bottom bed mattress engaging surface. Longitudinal edges extend between the upper and bottom surfaces and include an upwardly and outwardly inclined surface extending from the bottom surface. An opening is provided in one end of the pad for receiving a bedpan. The inclined surface on the longitudinal edges enables the pad to be positioned adjacent a patient which has been rolled toward one side at an angle relative to a bed mattress so that the pad can be positioned adjacent the patient whereupon the patient and the pad may be rolled back upon the mattress to position the patient on the pad and to position the pad on the bed mattress.

1 Claim, 5 Drawing Figures

APPARATUS AND METHOD FOR POSITIONING A BEDRIDDEN PATIENT ON A BEDPAN

SUMMARY OF THE INVENTION

Various types of pads and mattresses have been proposed to assist in positioning a patient on a bedpan for use of the bedpan. Some of such arrangements include means for securing the bedpan to the pad or mattress; others merely provide an opening for removably receiving a bedpan in a mattress or pad during use of the bedpan. However, all of such prior art devices present problems in that it is difficult for both the bedridden patient and the nurse or attendant to properly position the patient on the bedpan. The problem is accentuated with orthopedic patients, stout people, elderly or the very ill.

Further, once the bedpan has been placed on the pads or mattresses of prior art arrangements, the patient is then in an uncomfortable position which may make it difficult for them to properly empty themselves.

One of the primary objects of the present invention is to provide an arrangement and a method whereby a bedridden patient, regardless of size or incapacitating illness, may be quickly and readily and comfortably positioned on a bedpan for use of the bedpan.

Another primary object of the present invention is to provide a bedpan pad arrangement which not only quickly and easily positions the bedridden patient for use of the bedpan, but positions the patient comfortably during such use.

Yet a further object of the present invention is to provide a method of positioning a patient on a bedpan pad for use of a bedpan, and for removal of the patient from the bedpan pad after use of the bedpan has been completed.

Other objects and advantages of the present invention will become more readily apparent from a consideration of the following drawings and descriptions.

DESCRIPTION OF THE PREFERRED EMBODIMENT

Figure 5:
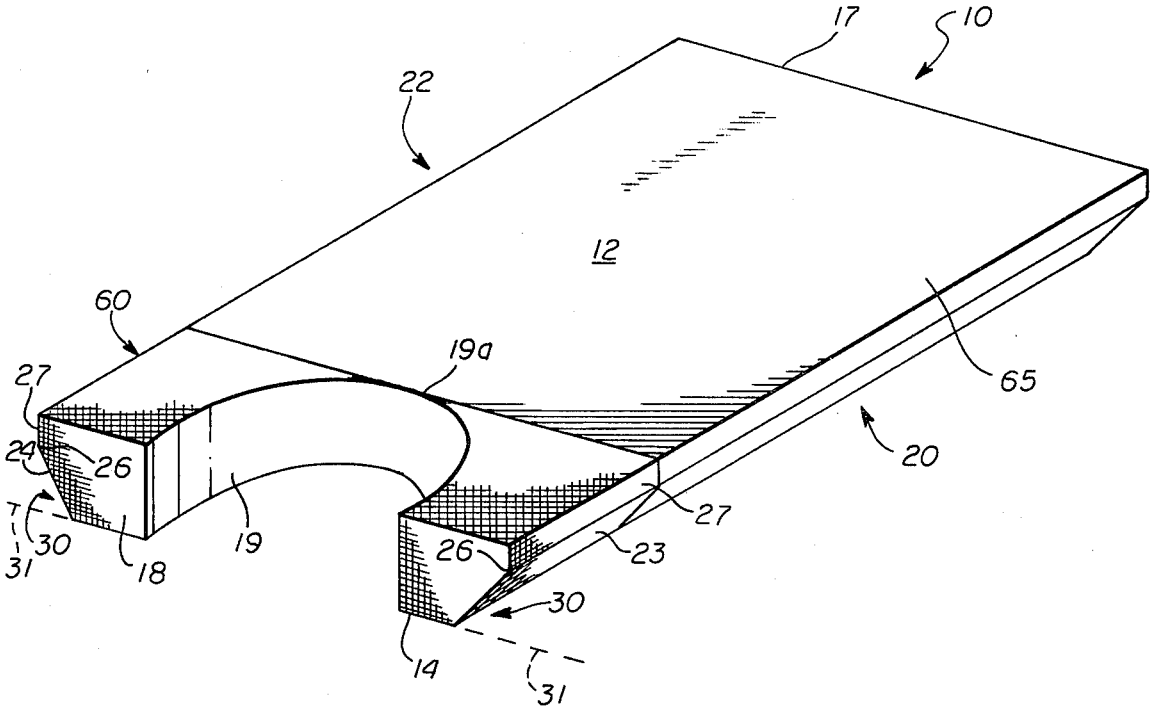
FIG. 5 is a perspective view illustrating the structural arrangement and configuration of the bedpan pad forming part of the present invention.

Attention is first directed to FIG. 5 of the drawings wherein the bedpan pad of the present invention is referred to generally by the numeral 10. It is of generally rectangular configuration as illustrated and comprises an upper patient support surface 12 which is preferably flat and a parallel bottom bed mattress engaging surface 14 for resting on the bed mattress top surface 15 during use. The rectangular pad includes the ends 17 and 18, the end 18 having an opening 19 formed therein of suitable size and configuration for receiving a bedpan therein.

The pad also includes longitudinally extending edges referred to generally by the numerals 20 and 22, respectively, which join the upper and lower surfaces 12 and 14 and extend continuously between the ends 17 and 18.

The longitudinally extending edges 20 and 22 each include a beveled or inclined surface 23 and 24 which is inclined at an angle relative to the bottom surface 14 and extends upwardly and outwardly relative to the bottom surface 14 as more clearly illustrated in FIG. 5 of the drawings. In the embodiment shown, the longitudinally extending inclined edge surfaces 23 and 24 terminate at a position represented at 26 adjacent but spaced from the upper surface 12 as shown in FIG. 5. In some instances, it may be desirable to extend the incline continuously from the lower or bottom surface 14 continuously to the upper surface 12, thus eliminating the vertically extending edge surface portion 27 which extends from the position 26 upwardly to the top surface 12 as shown in FIG. 5 of the drawings.

Preferably, the angle represented at 30 which is the angle between the beveled or inclined surfaces 23, 24 on the longitudinal edges 20, 22 and a plane represented by the line 31 which is coincident with a plane through the bottom surface 14 of the pad, is between 40° to approximately 75°.

The pad may be from approximately 32 inches to 44 inches in length and from about 14 inches to 24 inches in width and 2 to 5 inches in depth from the top surface 12 to the bottom surface 14.

The pad is preferably formed of a urethane foam having a density of approximately 1 to 4 pounds, which indention load deflection (ILD) is 50 pounds to 100 pounds (4 inch piece) under 25% deflection over 50 square inches. The sag factor of the preferred type of urethane foam is 1.8 to 2.2 (ratio) with a tensile strength of 22 to 28 pounds psi and which elongation is 110% to 135% and having a tear per inch of 2.0 to 4.0.

Figure 1:
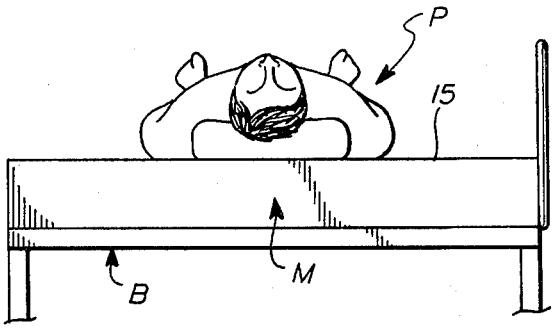
FIG. 1 is an end view of a bed mattress illustrating a patient thereon.
Figure 2:
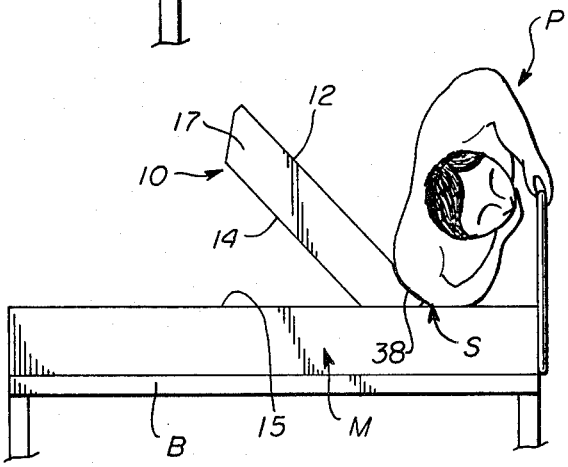
FIG. 2 illustrates the patient rolled to an angle on the bed mattress with the bedpan pad of the present invention positioned at an angle to enable the bedridden patient to be positioned on the bedpan pad of the present invention for use.

Attention is now directed to FIGS. 1–4 wherein the use of the present invention is further demonstrated. A bed mattress is illustrated in the drawings by the letter M which rests on a bed frame represented by the letter B. A patient represented by the letter P is shown as being on the bed mattress M normally in a reclined position as shown in FIG. 1. When it is desired to position the patient for bedpan use, the patient is rolled to one side as illustrated by the letter S in FIG. 2 at some angle relative to the top surface 15 of the bed mattress M. While the angle to which the patient is rotated is not critical, the preferred position is that demonstrated in FIG. 2 wherein the patient is rolled just beyond a generally vertical relationship with respect to the top surface 15 of the bed mattress M. Thereupon, the bedpan and patient positioning pad 10 of the present invention is also positioned at an angle, as shown in FIG. 2 of the drawings, on the top surface 15 of the bed mattress M so that the inclined surface on one of the longitudinally extending pad edges abuts the top surface 15 of the bed mattress M. This positions the top surface 12 of the pad 10 so that a longitudinal edge portion and top surface portion can be inserted between the side of the patient and the mattress M as shown in FIG. 2 immediately adjacent the patient. Since the pad 10 is formed of foam material, the foam will temporarily deform or collapse as it is positioned in the above defined relationship with the patient P and mattress M so as to conform with the adjacent body portion of the patient represented by the numeral 38.

Figure 3:
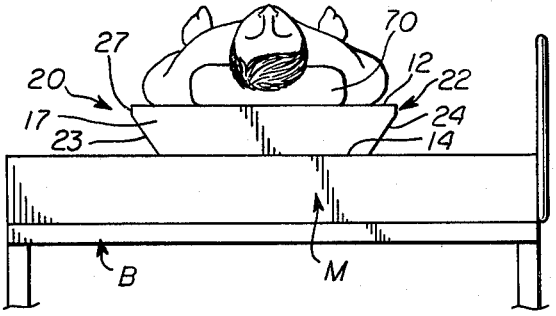
FIG. 3 illustrates the position of the bedridden patient, bedpan pad of the present invention and bed mattress after the patient and the bedpan pad have been rolled back onto the bed mattress for use of the bedpan.

Thereupon, the patient P is rolled back from the position illustrated in FIG. 2 onto the top surface 12 of the pad, and since the pad is pinned between the body of the patient and the top surface 15 of the bed mattress M as illustrated at 38 in FIG. 2, the pad 12 retains its position on the mattress M as the patient P is rolled towards the pad 10 and the pad 10 and patient P are then lowered onto the top 15 of the bed mattress M as demonstrated in FIG. 3 of the drawings.

Figure 4:
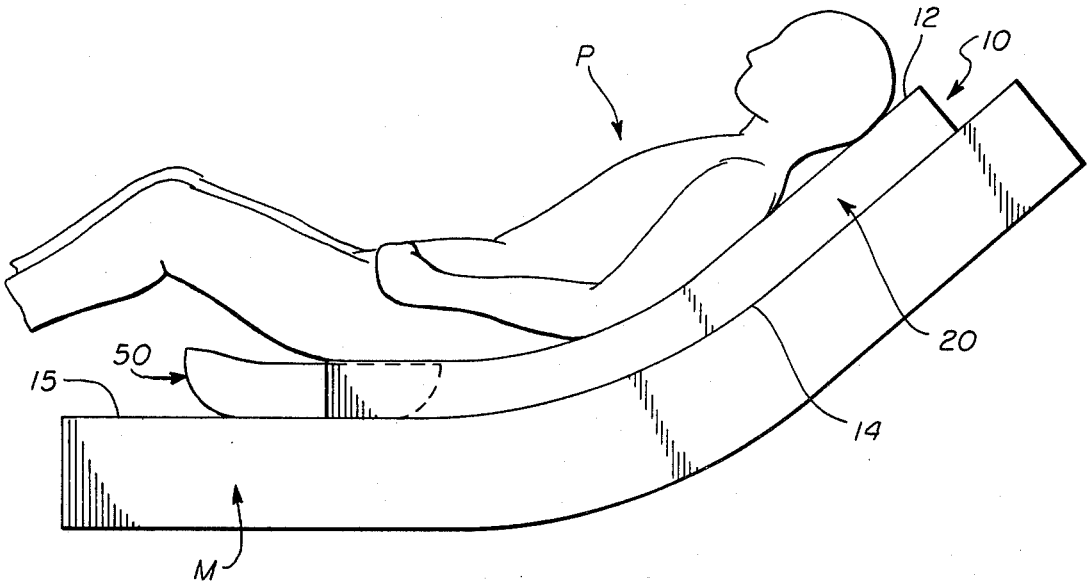
FIG. 4 is a partial side view illustrating that the bedpan pad of the present invention conforms with any angle of the bed mattress which may be most comfortable to the bedpan patient during use of the bedpan.

After this reclined position of the patient P has been accomplished on the pad 10 of the present invention, a bedpan represented generally by the numeral 50 in FIG. 4 is positioned in the opening 19 in the end 18 of the pad 10 for use.

If desired, the bed mattress represented at M can be adjusted to any suitable position as shown in FIG. 4 to better accommodate use of the bedpan 50 and to place the patient P in whatever position is most desirable to the patient to accommodate proper use of the bedpan 50. Also, a pillow 70, as shown in FIG. 3, may be placed under the patient's head.

After use of the bedpan 50 has been accomplished, the bedpan may be removed, and the bed mattress M returned to a horizontal position, if it has been moved from a horizontal position during use. The pad 10 and the patient P are then rolled toward one edge to the general position again represented in FIG. 2 of the drawings. The pad 10 may then be removed and the patient thereupon rolled back onto the top surface 15 of the bed mattress M.

The pad 10 is also provided with a waterproof cover for covering the foam, such waterproof cover being represented by the numeral 60 and in addition a removable and washable cover represented by the numeral 65 and extending from the edge 17 to the end **19*a* of the opening 19 is also provided as shown in FIG. 5**.

From the foregoing, it can be appreciated that the present invention not only provides a means of positioning a bedpan for use, but it provides a means and method to enable a patient to be properly positioned on a bedpan in a comfortable manner during use of the bedpan.

The foregoing disclosure and description of the invention are illustrative and explanatory thereof, and various changes in the size, shape and materials as well as in the details of the illustrated construction may be made without departing from the spirit of the invention.

What is claimed is:

1. A method of positioning a patient on and removing a patient from a generally rectangular bedpan pad on a bed mattress, which pad has an opening in one end for a bedpan and is provided with longitudinally extending beveled edges comprising the steps of:

a. positioning the patient at an angle on the bed mattress so that the back of the patient extends in a plane at an angle relative to the bed mattress surface;

b. positioning the pad at an angle on the bed mattress so that one of the longitudinal bevel edges is adjacent the tilted patient;

c. rolling the patient toward the tilted pad so that the beveled edge is clamped between the patient and the bed mattress whereupon continued rolling of the patient toward the pad positions the pad on the bed mattress and the patient on the bedpan pad;

d. positioning a bedpan in the pad opening for use by the patient and removing it after use;

e. rolling the pad and the patient to an angle relative to the bed mattress to remove the patient from the pad; and f. removing the pad from the bed mattress.

* * * * *